United States Patent [19]

Bland et al.

[11] Patent Number: 4,650,428

[45] Date of Patent: Mar. 17, 1987

[54] MARINE PROPULSION DEVICE WITH FLOATING DRIVE SHAFT

[75] Inventors: Gerald F. Bland, Glenview; Larry E. Zdanowicz, Waukegan, both of Ill.

[73] Assignee: Outboard Marine Corporation, Waukegan, Ill.

[21] Appl. No.: 723,310

[22] Filed: Apr. 15, 1985

[51] Int. Cl.[4] ..... B63H 23/04; B63H 5/12

[52] U.S. Cl. ..... 440/83; 440/64; 464/156

[58] Field of Search ..... 440/83, 75, 64, 57, 440/54; 464/156, 158, 159, 182

[56] References Cited

U.S. PATENT DOCUMENTS

| | | | |
|---|---|---|---|
| 1,780,075 | 10/1930 | Griffith | 440/56 |
| 1,790,856 | 2/1931 | Evinrude | 440/75 |
| 1,824,213 | 9/1931 | Johnson | 440/59 |
| 2,064,195 | 12/1936 | De Michelis | 440/75 X |
| 2,384,436 | 9/1945 | Bossen | 440/58 |
| 2,880,689 | 4/1959 | Bokowski | 440/62 |
| 2,917,019 | 12/1959 | Krueger | 440/56 |
| 2,936,730 | 5/1960 | Patty, Jr. | 440/56 |
| 3,006,311 | 10/1961 | Hansson | 440/63 |
| 3,025,822 | 3/1962 | Tenney | 416/93 R |
| 3,051,120 | 8/1962 | Standal | 440/53 |
| 3,138,010 | 6/1964 | Shipley | 464/158 |
| 3,181,494 | 5/1965 | Kiekhaefer | 440/86 |
| 3,183,880 | 5/1965 | Shimanckas | 440/52 |
| 3,256,851 | 6/1966 | Ackerman | 440/55 |
| 3,259,100 | 7/1966 | Kiekhaefer | 440/75 |
| 3,376,842 | 4/1968 | Wynne | 440/56 |
| 3,583,356 | 6/1971 | Barker | 440/82 |
| 3,584,474 | 6/1971 | Church | 464/156 |
| 3,896,757 | 7/1975 | Kucher | 440/58 |
| 4,274,827 | 6/1981 | Catsburg | 464/156 X |
| 4,534,737 | 8/1985 | Henderson . | |

FOREIGN PATENT DOCUMENTS

| | | |
|---|---|---|
| 568341 | 3/1945 | United Kingdom . |
| 1013142 | 12/1965 | United Kingdom . |
| 1034304 | 6/1966 | United Kingdom . |
| 1293999 | 10/1972 | United Kingdom . |
| 1358927 | 7/1974 | United Kingdom . |
| 1523143 | 8/1978 | United Kingdom . |
| 1571174 | 7/1980 | United Kingdom . |
| 2101270 | 1/1983 | United Kingdom . |

*Primary Examiner*—Sherman D. Basinger
*Assistant Examiner*—Paul Salmon
*Attorney, Agent, or Firm*—Michael, Best & Friedrich

[57] ABSTRACT

A marine propulsion device comprising a mounting bracket adapted to be mounted on the transom of a boat, and a propulsion unit pivotally mounted on the mounting bracket for pivotal movement relative to the mounting bracket about a generally vertical steering axis, the propulsion unit including a rotatably mounted propeller, a lower drive assembly drivingly connected to the propeller and having a generally vertical axis of rotation, an upper drive assembly adapted to be driven by an engine and having a generally vertical axis of rotation, and a floating drive shaft connecting the upper drive assembly to the lower drive assembly and permitting misalignment of the upper drive assembly axis of rotation relative to the lower drive assembly axis of rotation.

5 Claims, 3 Drawing Figures

MARINE PROPULSION DEVICE WITH FLOATING DRIVE SHAFT

BACKGROUND OF THE INVENTION

The invention relates to marine propulsion devices, and more particularly to marine propulsion device drive trains.

Prior marine propulsion devices include vertical drive shaft assemblies having an upper end fixedly connected to a bevel gear or to an engine crankshaft, and a lower end fixedly connected to a bevel gear. In some prior marine propulsion devices, the upper and lower ends of the vertical drive shaft assembly are fixedly connected to bevel gears by tight spline joints. Some prior vertical drive shaft assemblies include two or three drive shaft segments interconnected by spline-like joints.

In some prior marine propulsion devices, the axes of rotation of the upper and lower gears (at the opposite ends of the vertical drive shaft assembly) are or become misaligned so that undesirable bending and shearing stresses are imposed on the vertical drive shaft assembly. Such misalignment is especially common in marine propulsion devices having upper and lower gearcases, with the upper gear being mounted in the upper gearcase and the lower gear being mounted in the lower gearcase. Misalignment of the upper and lower gears results from imperfect connection of the two gearcases, or from the build-up of production tolerances.

Attention is directed to the following U.S. patents which disclose marine propulsion device vertical drive shaft assemblies:

| | | |
|---|---|---|
| Kucher | 3,896,757 | July 29, 1975 |
| Barker | 3,583,356 | June 8, 1971 |
| Wynne | 3,376,842 | April 9, 1968 |
| Kiekhaefer | 3,259,100 | July 5, 1966 |
| Ackerman | 3,256,851 | June 21, 1966 |
| Shimanckas | 3,183,880 | May 18, 1965 |
| Kiekhaefer | 3,181,494 | May 4, 1965 |
| Shipley | 3,138,010 | June 23, 1964 |
| Standal | 3,051,120 | Aug. 28, 1962 |
| Tenney | 3,025,822 | March 20, 1962 |
| Hansson | 3,006,311 | Oct. 31, 1961 |
| Patty, Jr. | 2,936,730 | May 17, 1960 |
| Krueger | 2,917,019 | Dec. 15, 1959 |
| Bokowski | 2,880,689 | April 7, 1959 |
| Bossen | 2,384,436 | Sept. 11, 1945 |
| Johnson | 1,824,213 | Sept. 22, 1931 |
| Evinrude | 1,790,856 | Feb. 3, 1931 |
| Griffith | 1,780,075 | Oct. 28, 1930 |

SUMMARY OF THE INVENTION

The invention provides a marine propulsion device comprising a mounting bracket adapted to be mounted on the transom of a boat, and a propulsion unit pivotally mounted on the mounting bracket for pivotal movement relative to the mounting bracket about a generally vertical steering axis, the propulsion unit including a rotatably mounted propeller, a lower drive assembly drivingly connected to the propeller and having a generally vertical axis of rotation, an upper drive assembly adapted to be drive by an engine and having a generally vertical axis of rotation, and drive means connecting the upper drive assembly to the lower drive assembly and permitting misalignment of the upper drive assembly axis of rotation relative to the lower drive assembly axis of rotation.

In one embodiment, the drive means includes a floating drive shaft having an upper end connected to the upper drive assembly, and a lower end connected to the lower drive assembly.

In one embodiment, the upper drive assembly includes an upper gear having a generally vertical axis of rotation, and the lower drive assembly includes a lower gear drivingly connected to the propeller and having a generally vertical axis of rotation, and a lower drive shaft drivingly connected to the lower gear and having an axis of rotation generally colinear with the lower gear axis of rotation.

In one embodiment, the drive means includes a floating drive shaft having an upper end connected to the upper gear, and a lower end connected to the lower drive shaft.

In one embodiment, the upper gear includes a splined socket, the lower drive shaft has an upper end including a splined socket, the upper end of the floating drive shaft includes splines loosely received in the socket in the upper gear, and the lower end of the floating drive shaft includes splines loosely received in the socket in the lower drive shaft.

The invention also provides a marine propulsion device comprising a mounting bracket adapted to be mounted on the transom of a boat, and a propulsion unit pivotally mounted on the mounting bracket for pivotal movement relative to the mounting bracket about a generally vertical steering axis, the propulsion unit including a rotatably mounted propeller, a lower drive assembly drivingly connected to the propeller and having a generally vertical axis of rotation, an upper drive assembly adapted to be driven by an engine and having a generally vertical axis of rotation, a floating drive shaft having an axis of rotation and upper and lower ends, upper drive means connecting the upper drive assembly to the upper end of the floating drive shaft and permitting a nonlinear angular relationship between the upper drive assemoly axis of rotation and the floating drive shaft axis of rotation, and lower drive means connecting the lower end of the floating drive shaft to the lower drive assembly and permitting a nonlinear angular relationship between the floating drive shaft axis of rotation and the lower drive assembly axis of rotation.

The invention also provides a marine propulsion device comprising a mounting bracket adapted to be mounted on the transom of a boat, and a propulsion unit pivotally mounted on the mounting bracket for pivotal movement relative to the mounting bracket about a generally vertical steering axis, the propulsion unit including an upper gearcase including an upper drive assembly adapted to oe driven by an engine, a lower gearcase removably connected to the upper gearcase and including a rotatably mounted propeller, and a lower drive assembly drivingly connected to the propeller, and a floating drive shaft having a lower end drivingly connected to the lower drive assembly and an upper end connected to the upper drive assembly in response to connection of the lower gearcase to the upper gearcase, one of the ends of the floating drive shaft being disconnected from the associated one of the drive assemblies and the other of the ends of the floating drive shaft being disconnected from the other of the drive assemblies in response to disconnection and removal of the lower gearcase from the upper gearcase.

The invention also provides a marine propulsion device comprising a mounting bracket adapted to be mounted on the transom of a boat, and a propulsion unit pivotally mounted on the mounting bracket for pivotal movement relative to the mounting bracket about a generally vertical steering axis, the propulsion unit including a rotatably mounted propeller, a lower drive assembly drivingly connected to the propeller and having a generally vertical axis of rotation, an upper drive assembly adapted to be driven by an engine and having a generally vertical axis of rotation in misaligned relation to the lower drive assembly axis of rotation, and a floating drive shaft connecting the upper drive assembly to the lower drive assembly without imposing substantial stress on the floating drive shaft.

In one embodiment, rotation of the propeller produces thrust, and the floating drive shaft connects the upper drive assembly to the lower drive assembly without imposing substantial stress on the floating drive shaft during both thrust and non-thrust conditions.

A principal feature of the invention is the provision of drive means connecting the upper drive assembly to the lower drive assembly and permitting misalignment, without substantial stress on the drive means, of the upper drive assembly axis of rotation relative to the lower drive assembly axis of rotation.

Another principal feature of the invention is the provision of upper drive means connecting the upper drive assembly to the upper end of the floating drive shaft and permitting a nonlinear angular relationship between the upper drive assembly axis of rotation and the floating drive shaft axis of rotation, and lower drive means connecting the lower end of the floating drive shaft to the lower drive assembly and permitting a nonlinear angular relationship between the floating drive shaft axis of rotation and the lower drive assembly axis of rotation. Again, this allows misalignment of the upper and lower drive assembly axes of rotation without imposing substantial stress on the floating drive shaft.

Another principal feature of the invention is the provision of a propulsion unit including an upper gearcase including an upper drive assembly adapted to be driven by an engine, a lower gearcase removably connected to the upper gearcase and including a lower drive assembly drivingly connected to a propeller, and a floating drive shaft having a lower end drivingly connected to the lower drive assembly, and an upper end connected to the upper drive assembly in response to connection of the lower gearcase to the upper gearcase, the upper end of the floating drive shaft being disconnected from the upper drive assembly in response to disconnection and removal of the lower gearcase from the upper gearcase.

Another principal feature of the invention is the provision of a propulsion unit including a lower drive assembly drivingly connected to a propeller and having a generally vertical axis of rotation, an upper drive assembly adapted to be driven by an engine and having a generally vertical axis of rotation in misaligned relation to the lower drive assembly axis of rotation, and a floating drive shaft connecting the upper drive assemoly to the lower drive assembly without imposing substantial stress on the floating drive shaft.

Other features and advantages of the invention will become apparent to those skilled in the art upon review of the following detailed description, claims, and drawings.

Figure 1:
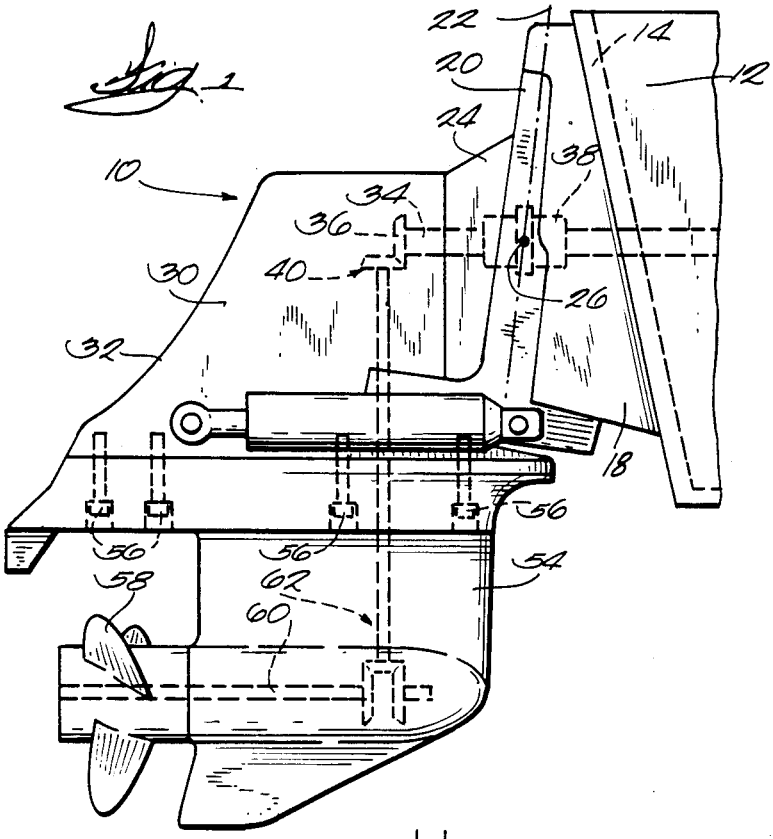
FIG. 1 is a side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a marine propulsion device 10 mounted on a boat 12 having a transom 14. The marine propulsion device 10 is of the stern drive or inboard/outboard type. However, it should be understood that the invention also applies to marine propulsion devices of the outboard motor type.

As best shown in FIG. 1, the marine propulsion device 10 comprises a mounting bracket or gimbal housing 18 mounted on the outer surface of the boat transom 14 and fixedly attached to the boat transom 14. The gimbal housing 18 can be attached to the boat transom 14 by any suitable means, such as by bolts extending through the transom 14.

The marine propulsion device 10 also comprises a gimbal ring 20 connected to the gimbal housing 18 for pivotal movement relative to the gimbal housing 18 about a generally vertical steering axis 22, and a pivot housing 24 connected to the gimbal ring 20 for pivotal movement relative to the gimbal ring 20 about a generally horizontal tilt axis 26. Such a construction is well known in the art and need not be described in greater detail.

The marine propulsion device 10 also comprises a propulsion unit 30 removably connected to the pivot housing 24 for common pivotal movement of the propulsion unit 30 with the pivot housing 24. In the illustrated construction, the propulsion unit 30 is removably connected to the pivot housing 24 by a plurality of bolts (not shown).

Figure 3:
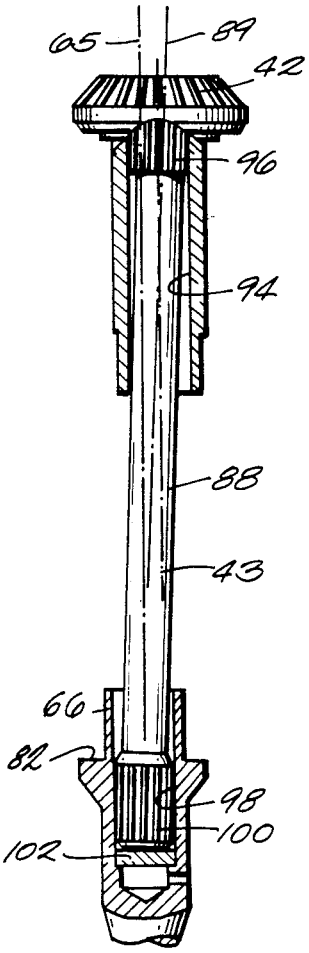
FIG. 3 is an exaggerated, schematic view showing misalignment of the upper and lower drive assembly axes of rotation.
Figure 2:
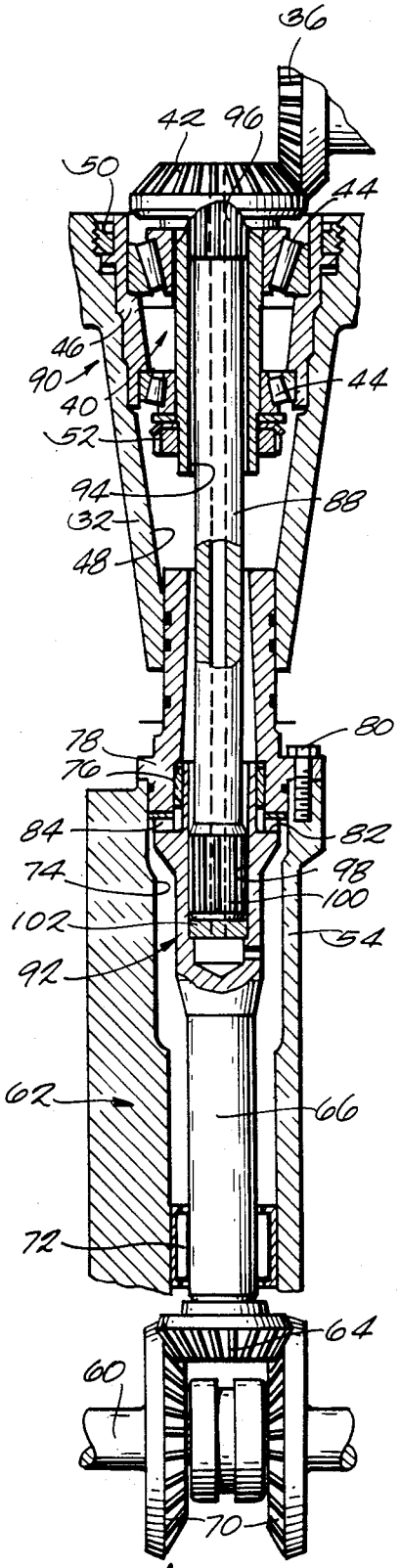
FIG. 2 is an enlarged view, partially in cross-section, of the vertical drive train of the marine propulsion device.

The propulsion unit 30 includes an upper gearcase 32 including a generally horizontal drive shaft 34 having one end removably connected to an engine (not shown) mounted inside the boat, and an opposite end having thereon a bevel gear 36. A universal joint 38 attached to the horizontal drive shaft 34 allows pivotal movement of the drive shaft 34 with the propulsion unit 30. The upper gearcase 32 also includes an upper drive assembly 40 preferably including an upper gear 42 (FIGS. 2 and 3) driven by the bevel gear 36 and having a generally vertical axis of rotation 43 (FIG. 3). As best shown in FIG. 2, the upper gear 42 is supported by a pair of upper and lower cone bearing assemblies 44 mounted within a bearing carrier 46. The bearing carrier 46 is received in the upper end of a drive shaft well 48 in the upper gearcase 32, and the bearing carrier 46 is secured within the drive shaft well 48 by an externally threaded nut 50 threaded into the upper gearcase 32. The lower cone bearing assembly 44 is supported from below by a nut 52 threaded onto the lower end of the upper gear 42.

In an alternative embodiment (not shown), the marine propulsion device is an outboard motor including a power head connected to an upper gearcase. The power head includes an engine having a generally vertical crankshaft, and the upper drive assembly is eitner the crankshaft or an extension thereof, instead of an upper gear.

The propulsion unit 30 also includes a lower gearcase 54 removably connected to the upper gearcase 32 by a plurality of bolts 56. The lower gearcase 54 includes a propeller 58 mounted on a propeller shaft 60. Rotation of the propeller 58 produces thrust. The lower gearcase 54 also includes a lower drive assembly 62 preferably including a lower gear 64 having a generally vertical axis of rotation 65 (FIG. 3), and a lower drive shaft 66 having an axis of rotation generally colinear with the lower gear axis 65, and having a lower end fixedly connected to the lower gear 64. In the preferred embodiment, the lower drive shaft 66 is connected to the lower gear 64 by a tight spline joint. A reversible transmission selectively clutches a pair of driven gears 70 to the propeller shaft 60 to transmit forward or reverse motion to the propeller shaft 60 from the lower gear 64.

The lower drive shaft 66 is supported at its lower end by a bearing assembly 72 held within a lower drive shaft well 74, and is supported at its upper end by a bearing assembly 76 held within a bearing carrier 78 removably connected to the lower gearcase 54. In the illustrated construction, the bearing carrier 78 is inserted into the upper end of the lower drive shaft well 74 and is connected to the lower gearcase 54 by one or more bolts 80. The upper end of the lower drive shaft 66 includes a shoulder 82, and a thrust bearing assembly 84 positioned between the shoulder 82 and the lower end of the bearing carrier 78 absorbs upward forces on the lower drive shaft 66.

The marine propulsion device 10 further comprises drive means connecting the upper gear 42 to the lower drive shaft 66 and permitting misalignment of the upper gear axis of rotation 43 relative to the lower gear axis of rotation 65. While various suitable drive means can be employed, in the preferred embodiment, the drive means includes a floating drive shaft 88 having an axis of rotation 89 (FIG. 3) and upper and lower ends, upper drive means 90 connecting the upper gear 42 to the upper end of the floating drive shaft 88 and permitting a nonlinear angular relationship between the upper gear axis of rotation 43 and the floating drive shaft axis of rotation 89, and lower drive means 92 connecting the lower end of the floating drive shaft 88 to the lower drive shaft 66 and permitting a nonlinear angular relationsnip between the floating drive shaft axis of rotation 89 and the lower drive shaft axis of rotation 65. In other words, the upper and lower drive means 90 and 92 connect the upper and lower ends of the floating drive shaft 88 respectively to the upper and lower gears 42 and 64 without imposing substantial stress on the floating drive shaft 88 during both thrust and non-thrust conditions.

In the preferred embodiment, the upper drive means 90 includes, in the upper gear 42, a splined socket 94, and, on the upper end of the floating drive shaft 88, splines 96 loosely received in the socket 94 in the upper gear 42. The lower drive means 92 includes, in the upper end of the lower drive shaft 66, a splined socket 98, and, on the lower end of the floating drive shaft 88, splines 100 loosely received in the socket 98 in the upper end of the lower drive shaft 66. The lower end of the floating drive shaft 88 is supported by a plug 102 in the bottom of the socket 98 in the upper end of the lower drive shaft 66. The plug 102 is preferably made of plastic and prevents metal to metal contact of the lower end of the floating drive shaft 88 with the bottom of the socket 98.

The upper and lower gearcases 32 and 54 and the drive means are constructed such that the lower end of the floating drive shaft 88 is connected to the lower drive shaft 66 and the upper end of the floating drive shaft 88 is connected to the upper gear 42 in response to connection of the lower gearcase 54 to the upper gearcase 32. Also, one of the ends of the floating drive shaft 88 is disconnected from the associated one of the upper gear 42 and lower drive shaft 66, and the other end of the floating drive shaft 88 is disconnectable from the other of the upper gear 42 and lower drive shaft 66, in response to disconnection and removal of the lower gearcase 54 from the upper gearcase 32. In other words, when the lower gearcase 54 is connected to the upper gearcase 32, the splines 96 on the upper end of the floating drive shaft 88 are received in the socket 94 in the upper gear 42 and the splines 100 on the lower end of the floating drive shaft 88 are received in the socket 98 in the upper end of the lower drive shaft 66, and, preferably, when the lower gearcase 54 is disconnected and removed from the upper gearcase 32, the splines 96 are removed from the socket 94, and the splines 100 are removable from the socket 98.

The marine propulsion device 10 is preferably assembled as follows. The upper gear 42 and cone bearing assemblies 44 are inserted into the bearing carrier 46, and the lower cone bearing assembly 44 is secured by threading the nut 52 onto the lower end of the upper gear 42. The bearing carrier 46 including the bearing assemblies 44 and the upper gear 42 is secured to the upper gearcase 32 by threading the nut 50 into the upper and of the drive shaft well 48. The lower drive shaft 66 and lower gear 64 are secured in the lower gearcase 54 by positioning the bearing assemblies 72 and 76 and connecting the bearing carrier 78 to the lower gearcase 54 with the bolt 80. The lower end of the floating drive shaft 88 is then inserted into the upper end of the lower drive shaft 66. Finally, the lower gearcase 54 is connected to the upper gearcase 32. Incident thereto, the upper end of the floating drive shaft 88 is inserted into the lower end of the drive shaft well 48 in the upper gearcase 32 and then into the socket 94 in the upper gear 42. When the lower gearcase 54 is secured to the upper gearcase 32 by the bolts 56, the floating drive shaft 88 is fully connected to the upper gear 42.

To disassemble the marine propulsion device 10, the bolts 56 are removed, thereby disconnecting the lower gearcase 54 from the upper gearcase 32, and the lower gearcase 54 is removed from the upper gearcase 32, thereby disconnecting the upper end of the floating drive shaft 88 from the upper gear 42.

Various other features and advantages of the invention are set forth in the following claims.

We claim:

1. A marine propulsion device comprising a mounting bracket adapted to be mounted on the transom of a boat, and a propulsion unit pivotally mounted on said mounting bracket for pivotal movement relative to said mounting bracket about a generally vertical steering axis, said propulsion unit including an upper gearcase including an upper gear adapted to be driven by an engine, said upper gear having a generally vertical axis of rotation and including a splined socket, a lower gearcase removably connected to said upper gearcase and including a rotatably mounted propeller, a lower gear drivingly connected to said propeller and having a generally vertical axis of rotation, and a lower drive shaft including a lower end drivingly connected to said lower gear, and an upper end including a splined socket, said lower drive shaft having an axis of rotation generally colinear with said lower gear axis of rotation, and a floating drive shaft having a generally vertical axis of rotation and including a lower end including splines loosely received in said socket in said lower drive shaft and an upper end including splines loosely received in said socket in said upper gear in response to connection of said lower gearcase to said upper gearcase, and said splines on one of said ends of said floating drive shaft being removed from the associated one of said sockets and said splines on the other of said ends of said floating drive shaft being removable from the other of said sockets in response to disconnection and removal of said lower gearcase from said upper gearcase.

2. A marine propulsion device comprising a mounting bracket adapted to be mounted on the transom of a boat, and a propulsion unit pivotally mounted on said mounting bracket for pivotal movement relative to said mounting bracket about a generally vertical steering axis, said propulsion unit including a lower housing including a rotatably mounted propeller, and a lower drive assembly drivingly connected to said propeller, being rotatably supported within said lower housing with a generally vertical axis of rotation and including a lower upwardly open splined socket, an upper housing including an upper drive assembly adapted to be driven by an engine, being rotatably supported within said upper housing with a generally vertical axis of rotation and including an upper downwardly open splined socket means for removably connecting said upper housing to said lower housing for common steering movement therewith, and a floating drive shaft having a splined lower end loosely and drivingly received in said lower splined socket and a splined upper end loosely and drivingly received in said upper splined socket.

3. A marine propulsion device as set forth in claim 2 wherein said upper drive assembly includes an upper gear having a generally vertical axis of rotation and including said upper splined socket, and wherein said lower drive asserbly includes a lower gear drivingly connected to said propeller and having a generally vertical axis of rotation, and a lower drive shaft drivingly connected to said lower gear and having an axis of rotation generally colinear with said lower gear axis of rotation and including said lower splined socket.

4. A marine propulsion device comprising a mounting bracket adapted to be mounted on the transom of a boat, and a propulsion unit pivotally mounted on said mounting bracket for pivotal movement relative to said mounting bracket about a generally vertical steering axis, said propulsion unit including an upper gearcase including an upper drive assembly adapted to be driven by an engine and including an upper gear rotatably supported by said upper gearcase and a downwardly open upper splined socket, a lower gearcase including a rotatably mounted propeller, and a lower drive assembly rotatably supported by said lower gearcase and including a lower gear drivingly connected to said propeller and an upwardly open lower splined socket, means for removably connecting said lower gearcase to said upper gearcase for common steering movement therewith, and a floating drive shaft having a splined lower end loosely and drivingly received in said lower splined socket and a splined upper end loosely and drivingly received in said upper splined socket.

5. A marine propulsion device as set forth in claim 4 wherein said upper gear has a generally vertical axis of rotation, and wherein said lower gear has a generally vertical axis of rotation, and wherein said lower drive assembly includes a lower drive shaft drivingly connected to said lower gear, and having an axis of rotation generally colinear with said lower gear axis of rotation and including, at the upper end thereof, said lower splined socket.

* * * * *